US008915416B2

(12) United States Patent
Huang

(10) Patent No.: US 8,915,416 B2
(45) Date of Patent: Dec. 23, 2014

(54) NAIL GUIDING DEVICE FOR NAILERS

(76) Inventor: Tsung-Wen Huang, Changhua County (TW)

( * ) Notice: Subject to any disclaimer, the term of this patent is extended or adjusted under 35 U.S.C. 154(b) by 541 days.

(21) Appl. No.: 13/408,610

(22) Filed: Feb. 29, 2012

(65) Prior Publication Data

US 2013/0221055 A1 Aug. 29, 2013

(51) Int. Cl.

| | |
|---|---|
| ***B25C 5/02*** | (2006.01) |
| ***B25C 5/11*** | (2006.01) |
| ***B25C 5/16*** | (2006.01) |

(52) U.S. Cl.

CPC ..... *B25C 5/1658* (2013.01); *B25C 5/11* (2013.01); *B25C 5/0257* (2013.01); *B25C 5/02* (2013.01); *B25C 5/1617* (2013.01)

USPC ..... 227/109; 227/120; 227/132; 227/142

(58) Field of Classification Search

CPC ..... B25C 5/02; B25C 5/0292; B25C 5/0285; B25C 5/0257; B25C 5/0242; B25C 5/11; B25C 5/1648; B25C 5/1658; B25C 5/1617; B25C 5/1662; B25C 5/1641; B25C 5/1642; B25C 5/1644

USPC ..... 227/109, 120, 123, 127, 132, 136, 140, 227/142, 151

See application file for complete search history.

(56) References Cited

U.S. PATENT DOCUMENTS

| | | | | | |
|---|---|---|---|---|---|
| 3,305,156 | A * | 2/1967 | Khan | 227/132 |
| 3,347,439 | A * | 10/1967 | Doherty | 227/109 |
| 4,025,031 | A * | 5/1977 | Chi | 227/132 |
| 4,552,296 | A * | 11/1985 | Sheng | 227/109 |
| 4,693,407 | A * | 9/1987 | Buck et al. | 227/109 |
| 5,884,829 | A * | 3/1999 | Wingert | 227/151 |
| 5,967,397 | A * | 10/1999 | Fealey | 227/132 |
| 6,131,788 | A * | 10/2000 | Marks | 227/132 |
| 6,698,642 | B2 * | 3/2004 | Chen | 227/120 |
| 6,848,607 | B2 * | 2/2005 | Boswinkel et al. | 227/132 |
| 7,562,801 | B2 * | 7/2009 | Pelletier et al. | 227/156 |
| 8,240,535 | B2 * | 8/2012 | Shor | 227/140 |
| 8,413,865 | B2 * | 4/2013 | Mandel et al. | 227/30 |

* cited by examiner

*Primary Examiner* — Scott A. Smith

(57) ABSTRACT

A nail guiding device for nailers includes a guide plate located between the opening of the casing of the nailer and the magazine. The guide plate has a guide slot and two flanges on two sides of the guide slot. The end of the cover contacts the flanges and the strike plate is movable within the guide slot. The guide plate has at least one guide block on a face facing the opening. An adjustment plate is located in the casing and has at least one adjustment block. A resilient member located in the casing and biases the guide plate to make the at least one guide block contact the at least one adjustment block or move over the at least one guide block to adjust the distance between the guide plate and the magazine, such that the nails of different sizes can be used in the nailer.

8 Claims, 8 Drawing Sheets

NAIL GUIDING DEVICE FOR NAILERS

FIELD OF THE INVENTION

The present invention relates to a nail guiding device, and more particularly, to a nail guiding device for nailers and the widths of the outlet for the nails can be adjusted for different sizes of the nails.

BACKGROUND OF THE INVENTION

Taiwan Utility Model Application No. 100116284 discloses a nail guiding device and comprises a guide plate, an assistance member, a resilient member and a contact member. The guide plate has a first face and a second face, wherein the first face faces the nail track. The guide plate has a positioning slot and the first face has a guide slot with which the strike plate or nails are moved along. The assistance member is located corresponding to the positioning slot of the guide plate and has a contact end and a push end. The contact end protrudes beyond the first face. The resilient member is mounted to the push end of the assistance member so as to bias the push end of the assistance member. A contact device has a contact member, a switch plate and a connection plate, the contact member is movable between a contact position and an open position. The second face that faces the guide plate contacts the assistance member to restrict the assistance member from being moved to the second position. When the contact member is located at the open position, the contact member is separated from the assistance member so that the assistance member is movable between the first and second positions. The connection plate has a protrusion and the contact member has a notch which accommodates the protrusion so that the contact member is moved by the connection plate. When the switch plate is switched, the connection plate is moved and the contact member is moved between the opening position and the contact position to allocate the assistance member between the first position and the second position. By this movement of the contact member, nails of different thicknesses can be installed to the nailer.

However, there require at least the switch plate, the connection plate, the contact member and the assistance member to be cooperated with each other to achieve the purpose. The more parts are involved for this purpose, the higher manufacturing cost and high assembling time are required.

The present invention intends to provide a nail guiding device for nailers to improve the shortcomings of the existed nail guiding devices.

SUMMARY OF THE INVENTION

The present invention relates to a nailer and comprises a casing having a space defined therein and an opening is defined in the front end of the casing. A resilient plate is located in the space of the casing and connected to a strike plate. An arm is connected to the casing and has a first end connected with the strike plate and a push end is formed on the second end of the arm. A magazine is fixed at the inner end of the space and a cover is mounted to the magazine. A guide plate is located between the opening and the magazine, and has a guide slot defined in a face facing the magazine. Two flanges extend from two sides of the guide slot and an end of the cover contacts the flanges. The strike plate is movable within the guide slot. The guide plate has at least one guide block on a face facing the opening. An adjustment plate is located in front of the opening and has at least one adjustment block on the first face thereof and facing the at least one guide block. The adjustment plate is movable relative to the guide plate. The adjustment plate has an operation portion formed on the second face thereof.

The primary object of the present invention is to provide a nail guiding device for nailers and the structure of the nail guiding device is simplified. The operation is easy by simply switching the adjustment plate to adjust the adjustment blocks relative to the guide blocks to move the guide plate so as to adjust the gap between the guide plate and the magazine for accommodating the nails of different sizes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
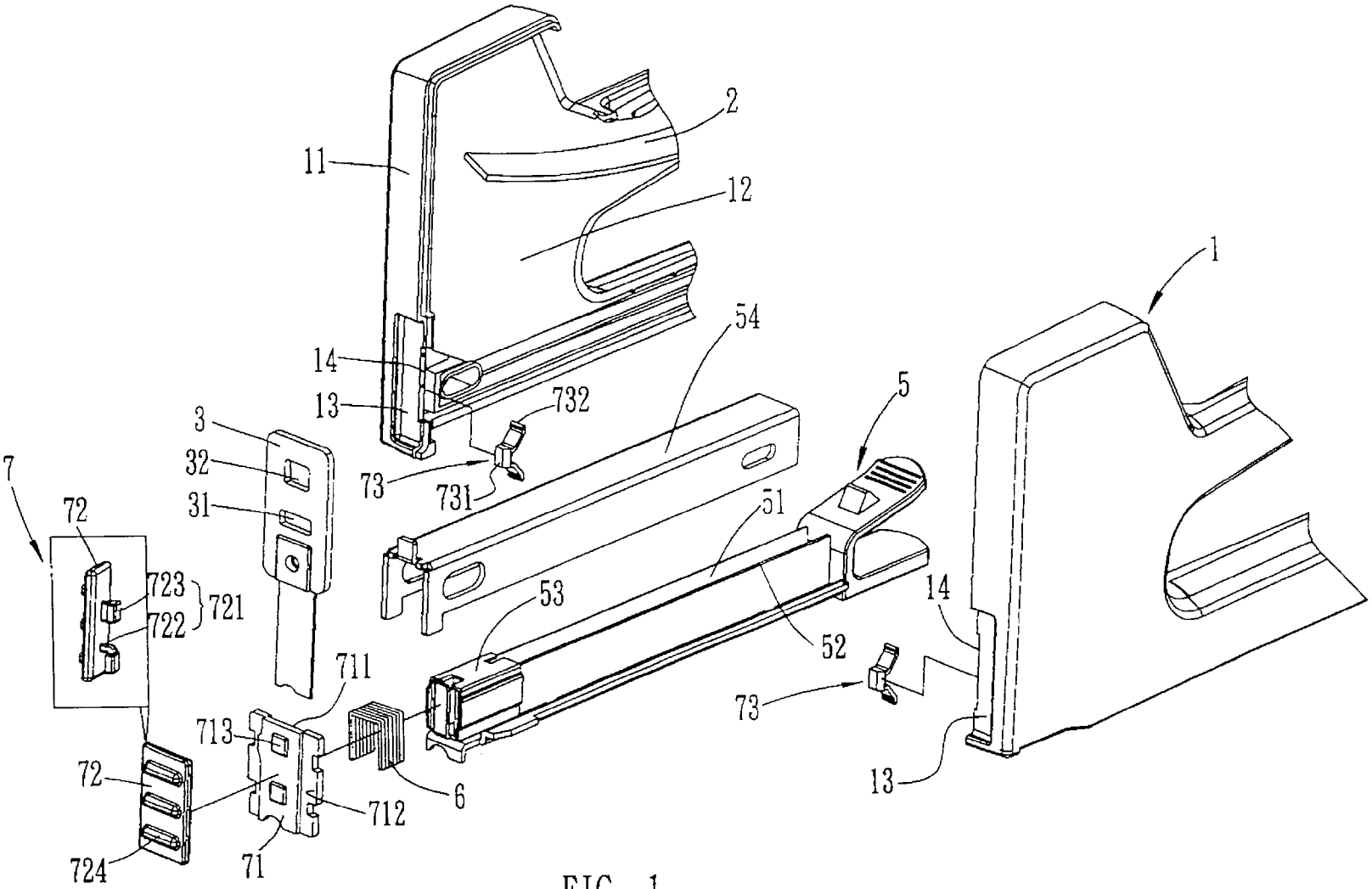
FIG. 1 is an exploded view to show the nail guiding device of the present invention.
Figure 2:
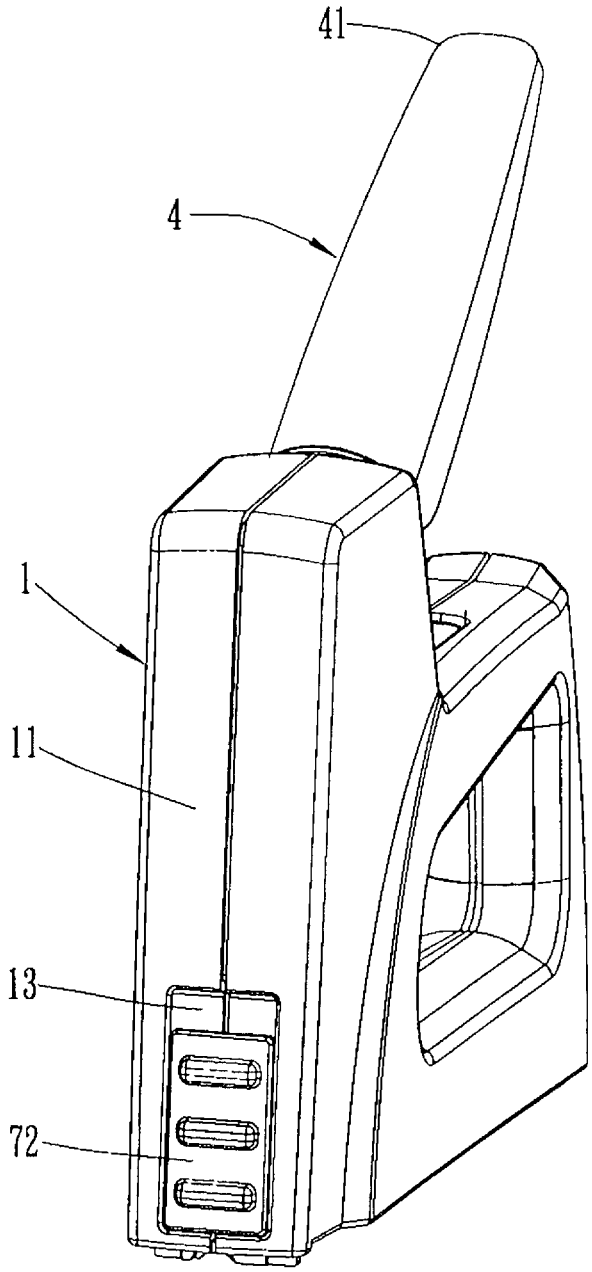
FIG. 2 is a perspective view to show a nailer with the nail guiding device of the present invention.

Referring to FIGS. 1 and 2, the nailer 1 comprises a casing 11 which is composed of two parts and a space 12 is defined in the casing 11. An opening 14 is defined in the front end of the casing 11 and communicates with the space 12. A resilient plate 2 is located in the space 12 of the casing 11 so as to store and release a force to operate the nails. A recess 13 is defined in the front end of the casing 11 and communicates with the opening 14. A strike plate 3 is located in the space 12 and has a first hole 31 and a second hole 32. The strike plate 3 is located at the front end of the casing 11 and the front end of the resilient plate 2 is engaged with the first hole 31. When the strike plate 3 is moved upward, the resilient plate 2 stores the force which is release to move the strike plate 3 downward when being released.

An arm 4 is connected to the casing 11 and has the first end connected with the second hole 32 of the strike plate 3. A push end 41 is formed on the second end of the arm 4. When pivoting the arm 4, the strike plate 3 moves.

A magazine 5 is fixed at the inner end of the space 12 and comprises a chamber 51, two sidewalls 52 on two sides of the magazine 5, a push plate 53 and a cover 54. Nails 6 are accommodated in the chamber 51 and the push plate 53 is mounted among the chamber 51 and the sidewalls 52 so as to push the nails 6 forward. The cover 54 is mounted to the two sidewalls 52.

The nail guiding device 7 of the present invention comprises a guide plate 71, an adjustment plate 72 and two resilient members 73. The guide plate 71 is located between the opening 14 and the magazine 5. A guide slot 711 is defined in a face of the guide plate 71 and faces the magazine 5, two flanges 712 extend from two sides of the guide slot 711. An end of the cover 54 contacts the flanges 712 and the strike plate 3 is movable within the guide slot 711. The guide plate 71 has two guide blocks 713 on the face facing the opening 14. The adjustment plate 72 is located in the recess 13 defined in the front end of the opening 14 and has two adjustment blocks 721 on the first face thereof and the adjustment blocks 721 face the guide blocks 713. The adjustment plate 72 is movable relative to the guide plate 71 and has an operation portion 724 formed on the second face thereof. Each of the adjustment blocks 721 has a neck 722 extending from the adjustment plate 72 and a contact portion 723 is connected to a distal end of the neck 722. The neck 722 extends through the opening 14 of the casing 11 and is movable in the opening 14. The contact portions 723 movably contact the guide blocks 713 so that the guide plate 71 can be moved relative to the magazine 5. The two resilient members 73 each have a protrusion 731 and two fixing ends 732. The protrusions 731 contacts back of the flanges 712 and the fixing ends 732 are fixed to the inside of the space 12 so that the resilient members 73 resiliently guide the movement of the guide plate 71 as shown in FIGS. 3 and 4.

As shown in FIGS. 1 to 4, when assembling the nailer 1, the resilient plate 2, the strike plate 3 and the arm 4 are respectively connected to the space 12 of the casing 11, the resilient plate 2 is engaged with the first hole 31 of the strike plate 3 and the arm 4 is engaged with the second hole 32 of the strike plate 3. The magazine 5 is located in the space 12 and the push plate 53 is mounted among the chamber 51 and the sidewalls 52. The cover 54 is then mounted to the two sidewalls 52 and the push plate 53. The guide plate 71 is inserted between the inside of the opening 14 and the magazine 5. The protrusions 731 of the two resilient members 73 contact back of the flanges 712 and the fixing ends 732 are fixed to the inside of the space 12 so that the resilient members 73 resiliently guide the movement of the guide plate 71. The neck 722 extends through the opening 14 of the casing 11 and is movable in the opening 14. The contact portions 723 movably contact the guide blocks 713 so that the guide plate 71 can be moved relative to the magazine 5. The flanges 712 of the guide plate 71 contact the end of the cover 54.

Figure 3:
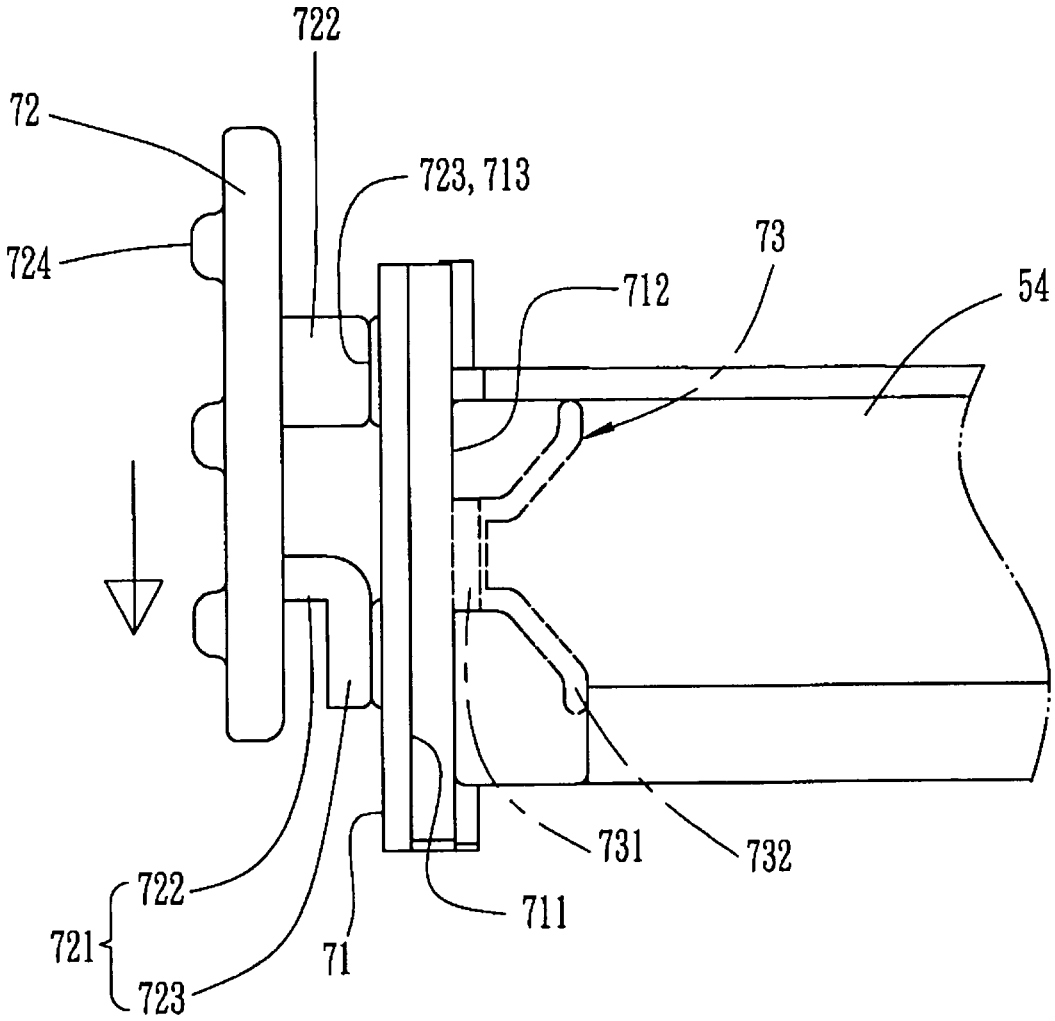
FIG. 3 shows that the adjustment plate of the nail guiding device of the present invention is moved downward.
Figure 4:
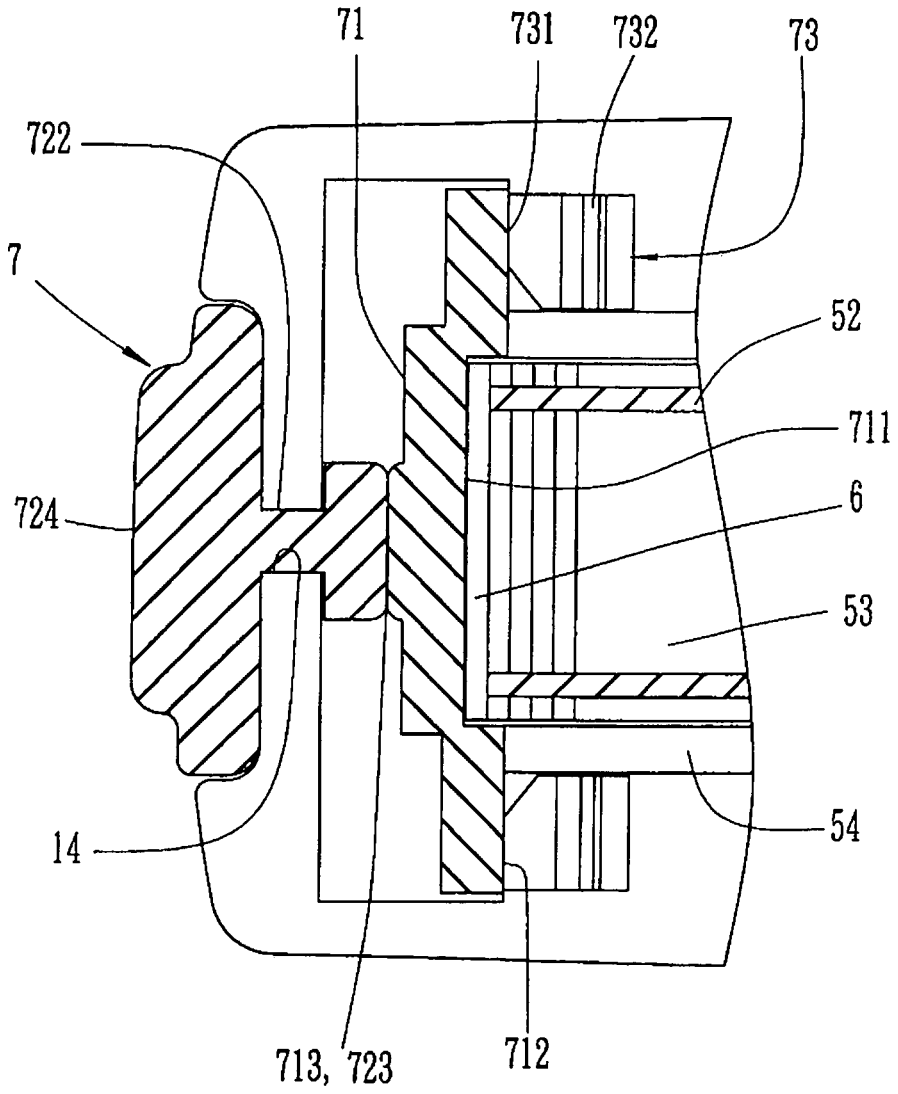
FIG. 4 is a cross sectional view to show that the 0.7 mm 53 nails are installed to the nailer.
Figure 5:
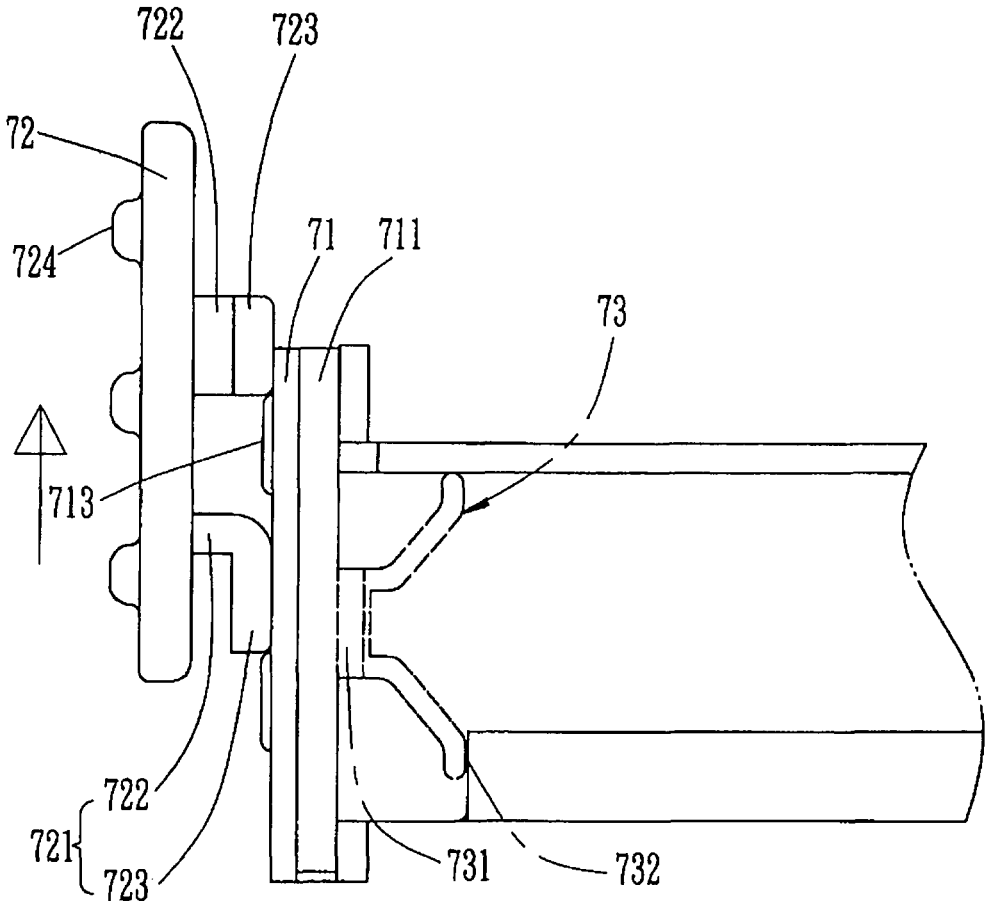
FIG. 5 shows that the adjustment plate of the nail guiding device of the present invention is moved upward.

Referring to FIGS. 2 to 8, when using the nail guiding device 7, the user adjusts the gap between the guide slot 711 of the guide plate 71 and the magazine 5 so as to match the required size of the nails 6. As shown in FIGS. 2 to 4, when using the 0.7 mm 53 nails 6, the user moves the operation portion 724 of the adjustment plate 72 downward so that the adjustment plate 72 is moved downward in the recess 13, the contact portions 723 of adjustment blocks 721 contact the guide blocks 713 on the guide plate 71. This guides the guide plate 71 to move toward the magazine 5. The flanges 712 of the guide plate 71 contact the cover 54. The gap is defined between two respective front ends of the sidewalls 52 and an inside of the guide slot 711, and the gap is slightly larger than 0.7 mm. The 0.7 mm 53 nails 6 are mounted to between the two outsides of the sidewalls 52 and the cover 54. The push plate 53 pushes the nails 6 and the lower end of the nails 6 protrudes from the sidewalls 52 and are located in the guide slot 711. The strike plate 3 moves downward in the guide slot 711 to strike the nails 6.

Figure 6:
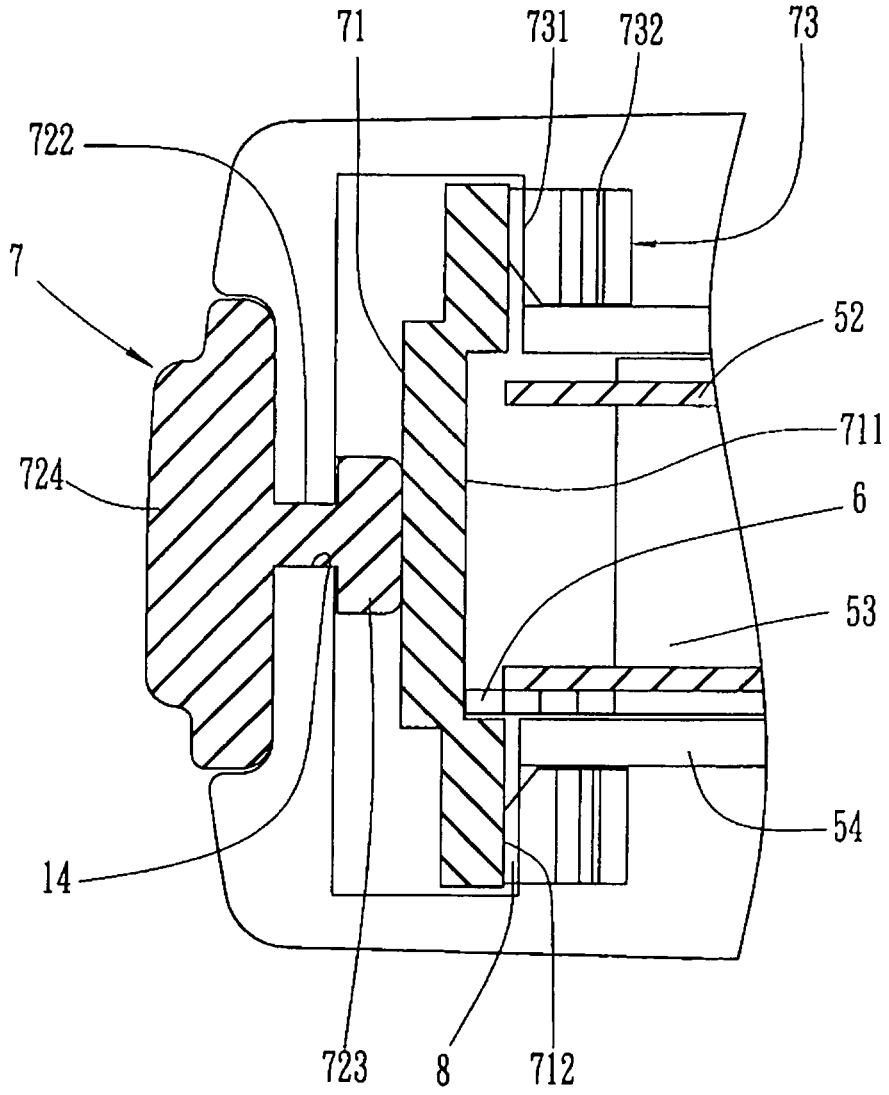
FIG. 6 is a cross sectional view to show that the 1.2 mm T type nails are installed to the nailer.
Figure 7:
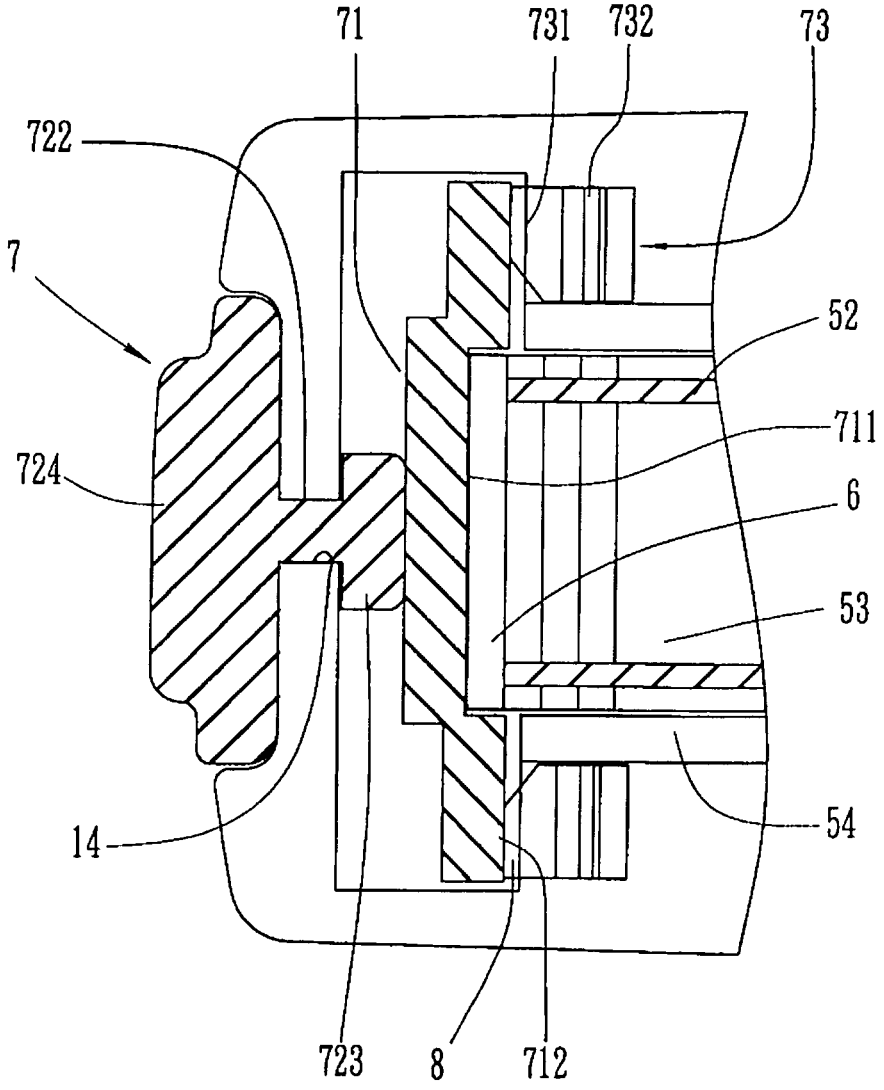
FIG. 7 is a cross sectional view to show that the 1.2 mm T-50 nails are installed to the nailer.
Figure 8:
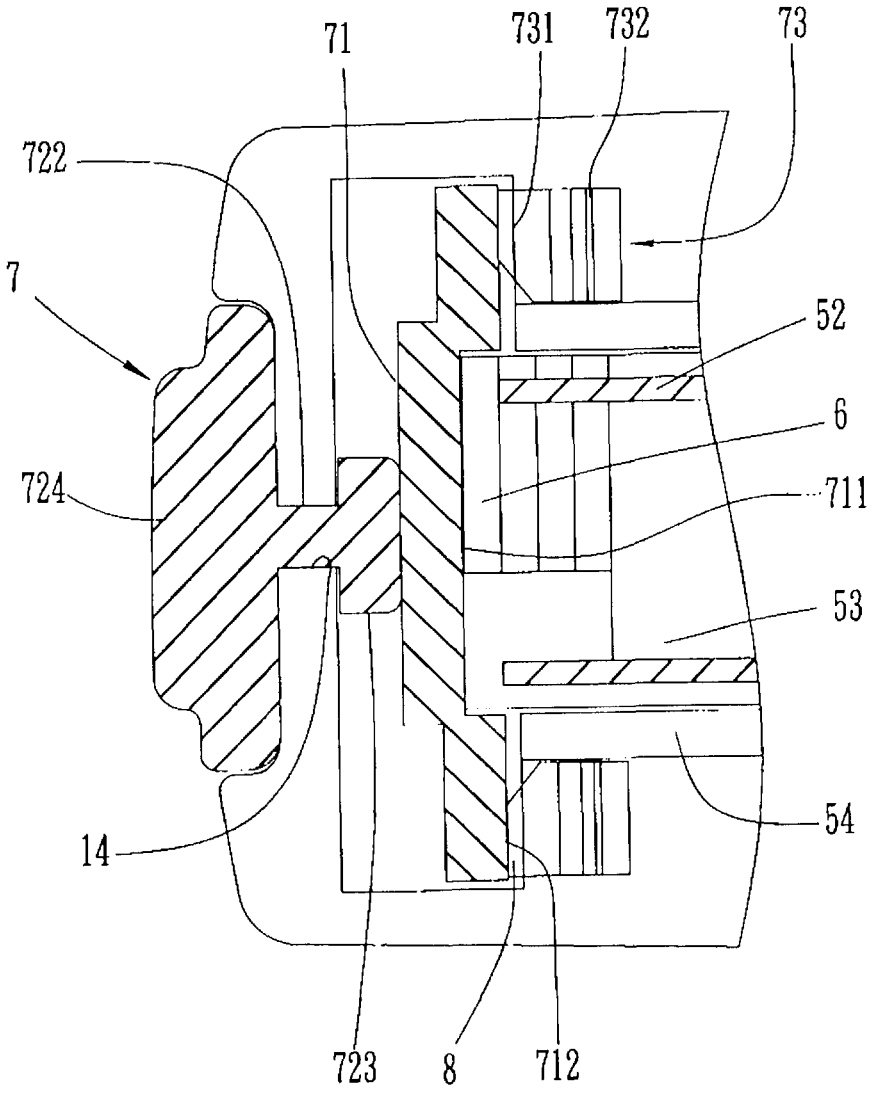
FIG. 8 is a cross sectional view to show that the 1.2 mm U type nails are installed to the nailer.

As shown in FIGS. 5 to 8, when using the 1.2 mm T type nails 6 or T-50 nails 6 or U-type nails 6, the user moves the operation portion 724 of the adjustment plate 72 upward so that the adjustment plate 72 is moved upward in the recess 13. The contact portions 723 of adjustment blocks 721 move over the guide blocks 713 on the guide plate 71. The guide plate 71 is pushed forward by the resilient members 73 to form a gap 8 between the flanges 712 of the guide plate 71 and the cover 54. The distance defined between two respective front ends of the sidewalls 52 and the inside of the guide slot 711 is slightly larger than 1.2 mm. The T-type nails 6 are installed to the outside of one sidewall 52 and the inside of the cover 54 as shown in FIG. 6. The T-50 nails 6 are mounted to the outsides of the sidewalls 52 and the inside of the cover 54 as shown in FIG. 7. The U-type nails 6 has one side there inserted between the outside of one sidewall 52 and the inside of the cover 54, the other side of the U-type nails 6 is mounted across the insides of the sidewalls 52 as shown in FIG. 8. The push plate 53 pushes the nails 6 and the lower end of the nails 6 protrudes from the sidewalls 52 and the front end of the nails 6 contacts the inside of the guide slot 711. The strike plate 3 moves downward in the guide slot 711 to strike the nails 6. The different sizes of the nails 6 can be used to the nail guiding device 7 by moving the adjustment plate 72 to let the adjustment blocks 721 contact or move over the guide blocks 713 to adjust the relative positions between the guide plate 71 and the sidewalls 52 of the magazine 5.

While we have shown and described the embodiment in accordance with the present invention, it should be clear to those skilled in the art that further embodiments may be made without departing from the scope of the present invention.

What is claimed is:

1. A nailer comprising:

a casing having a space defined therein and an opening defined in a front end of the casing;

a resilient plate located in the space of the casing;

a strike plate having a first hole and a second hole, the strike plate located in the space and located at a front end of the casing, a front end of the resilient plate engaged with the first hole;

an arm connected to the casing and having a first end connected with the second hole of the strike plate and a push end formed on a second end of the arm;

a magazine fixed at an inner end of the space and a cover mounted to the magazine;

a guide plate located between the opening and the magazine, the guide plate having a guide slot defined in a face facing the magazine and two flanges extending from two sides of the guide slot, an end of the cover contacting the flanges and the strike plate movable within the guide slot, the guide plate having at least one guide block on a face facing the opening, and an adjustment plate located in front of the opening and having at least one adjustment block on a first face thereof and facing the at least one guide block, the adjustment plate being movable relative to the guide plate, the adjustment plate having an operation portion formed on a second face thereof.

2. The nail guiding device as claimed in claim 1, wherein the casing has a recess defined in the front end thereof and the adjustment plate is located within the recess.

3. The nail guiding device as claimed in claim 1, wherein at least one adjustment block has a neck extending from the adjustment plate and a contact portion is connected to a distal end of the neck.

4. The nail guiding device as claimed in claim 3, wherein the neck extends through the opening of the casing and is movable in the opening, the contact portion movably contacts the at least one guide block so that the guide plate is moved relative to the magazine.

5. The nail guiding device as claimed in claim 1 further comprising two resilient members and each resilient member has a protrusion and two fixing ends, the protrusion contacts back of the flanges and the fixing ends are fixed to the inside of the space so that the resilient member resiliently guides movement of the guide plate.

6. The nail guiding device as claimed in claim 5, wherein the magazine has two sidewalls on two sides thereof and the cover is mounted to the two sidewalls.

7. The nail guiding device as claimed in claim 6, wherein the flanges of the guide plate contact the cover, a gap larger than 0.7 mm is defined between two respective front ends of the sidewalls and an inside of the guide slot.

8. The nail guiding device as claimed in claim 6, wherein the guide plate is pushed by the protrusions of the resilient members to form a gap between the flanges of the guide plate and the cover, a distance gap defined between two respective front ends of the sidewalls and the inside of the guide slot is larger than 1.2 mm.

* * * * *